US012398932B2

(12) United States Patent
Jakobsen et al.

(10) Patent No.: US 12,398,932 B2
(45) Date of Patent: Aug. 26, 2025

(54) APPARATUS FOR BEVERAGE CONTAINER TEMPERATURE CONTROL

(71) Applicant: Grad ApS, Copenhagen (DK)

(72) Inventors: Kenneth Holck Jakobsen, Solrød Strand (DK); Anders Bruus, Copenhagen (DK); Michael Skovbjerg, Copenhagen (DK); Ann-Marie Finn, Copenhagen (DK)

(73) Assignee: Grad ApS, Copenhagen (DK)

( * ) Notice: Subject to any disclaimer, the term of this patent is extended or adjusted under 35 U.S.C. 154(b) by 245 days.

(21) Appl. No.: 18/111,111

(22) Filed: Feb. 17, 2023

(65) Prior Publication Data

US 2023/0400233 A1 Dec. 14, 2023

Related U.S. Application Data

(63) Continuation-in-part of application No. 17/751,745, filed on May 24, 2022, now Pat. No. 12,235,041.

(60) Provisional application No. 63/194,275, filed on May 28, 2021.

(51) Int. Cl.
*F25B 21/04* (2006.01)
*F25D 31/00* (2006.01)

(52) U.S. Cl.
CPC ..... *F25B 21/04* (2013.01); *F25D 31/007* (2013.01)

(58) Field of Classification Search
CPC ..... F25B 2700/2107; F25B 2321/0212; F25B 2331/805; F25B 31/007; F25B 21/04; F25D 2331/805
See application file for complete search history.

(56) References Cited

U.S. PATENT DOCUMENTS 2,991,628 A * 7/1961 Tuck ..... F25B 21/04 136/238
4,164,851 A 8/1979 Bryant
4,681,611 A 7/1987 Bohner
4,704,872 A 11/1987 Jones
4,823,554 A 4/1989 Trachtenberg et al.
4,891,949 A 1/1990 Caldarola
4,913,713 A 4/1990 Bender et al.
(Continued)

FOREIGN PATENT DOCUMENTS

AU 2005101069 2/2006
CN 201548014 U 8/2010
(Continued)

OTHER PUBLICATIONS

English language machine translation of WO2017/19194 to Tanaka. Translated Dec. 2024 (Year: 2017).*
(Continued)

*Primary Examiner* — Cassey D Bauer
(74) *Attorney, Agent, or Firm* — DiBerardino McGovern IP Group LLC

(57) ABSTRACT

Apparatus for controlling the temperature of a beverage container, for example, by either chilling the beverage container or maintaining the beverage container at a predetermined temperature, the apparatus including a thermoelectric element configured to operate at a first voltage, and a voltage converter adapted to down convert the output voltage of at least one battery to the first voltage and for supplying the first voltage to the thermoelectric element.

21 Claims, 14 Drawing Sheets

(56) References Cited

U.S. PATENT DOCUMENTS

| | | | | |
|---|---|---|---|---|
| 5,029,446 | A | 7/1991 | Suzuki | |
| 5,409,547 | A | 4/1995 | Watanabe et al. | |
| 5,634,343 | A | 6/1997 | Baker | |
| 5,720,171 | A | 2/1998 | Osterhoff et al. | |
| 5,862,669 | A | 1/1999 | Davis et al. | |
| 6,003,318 | A | 12/1999 | Busick et al. | |
| 6,096,032 | A | 8/2000 | Rowland | |
| 6,119,461 | A | 9/2000 | Stevick et al. | |
| 6,141,969 | A | 11/2000 | Launchbury et al. | |
| 6,338,252 | B1 | 1/2002 | Calderaio | |
| 6,351,964 | B1 | 3/2002 | Brancheau et al. | |
| 6,640,551 | B1 | 11/2003 | Slone et al. | |
| 6,732,533 | B1 | 5/2004 | Giles | |
| 7,089,749 | B1 | 8/2006 | Schafer | |
| 7,334,414 | B2 | 2/2008 | Park | |
| 7,934,384 | B2 | 5/2011 | Tuskiewicz et al. | |
| 8,397,519 | B2 | 3/2013 | Loibl et al. | |
| 8,468,836 | B2 | 6/2013 | Tuszkiewicz et al. | |
| 8,512,430 | B2 | 8/2013 | Manahan et al. | |
| 8,727,179 | B2 | 5/2014 | Colelli et al. | |
| 9,752,808 | B2 | 9/2017 | Nakamura et al. | |
| 9,975,462 | B2 | 5/2018 | Doi | |
| 10,010,213 | B2 * | 7/2018 | Alexander | A47J 27/21083 |
| 10,113,791 | B2 | 10/2018 | Wenji et al. | |
| 2003/0031777 | A1 | 2/2003 | Lucatello | |
| 2004/0035119 | A1 | 2/2004 | Slone et al. | |
| 2005/0274119 | A1 | 12/2005 | Lee | |
| 2006/0117760 | A1 | 6/2006 | Pieronczyk et al. | |
| 2006/0188418 | A1 | 8/2006 | Park et al. | |
| 2006/0218937 | A1 | 10/2006 | Park | |
| 2006/0260324 | A1 | 11/2006 | Luzaich et al. | |
| 2007/0193280 | A1 | 8/2007 | Tuskiewicz et al. | |
| 2008/0148753 | A1 | 6/2008 | Welker et al. | |
| 2010/0058776 | A1 | 3/2010 | Loibl et al. | |
| 2010/0115969 | A1 | 5/2010 | Tuszkiewicz et al. | |
| 2010/0115986 | A1 | 5/2010 | Wang | |
| 2010/0258268 | A1 | 10/2010 | Li | |
| 2011/0011099 | A1 | 1/2011 | Linder | |
| 2012/0093650 | A1 | 4/2012 | Huber | |
| 2012/0217772 | A1 | 8/2012 | Tang | |
| 2012/0266609 | A1 | 10/2012 | Liu et al. | |
| 2014/0069111 | A1 | 3/2014 | Campbell et al. | |
| 2014/0157794 | A1 | 6/2014 | McGann | |
| 2014/0165621 | A1 | 6/2014 | Boarman et al. | |
| 2014/0190185 | A1 | 7/2014 | Bell et al. | |
| 2015/0230631 | A1 | 8/2015 | Nuttall et al. | |
| 2015/0245723 | A1 | 9/2015 | Alexander | |
| 2015/0273560 | A1 | 10/2015 | Pilon et al. | |
| 2015/0323246 | A1 | 11/2015 | Spivey et al. | |
| 2016/0018115 | A1 | 1/2016 | Arjomand | |
| 2016/0018138 | A1 | 1/2016 | Liptak et al. | |
| 2016/0236605 | A1 | 8/2016 | Doi | |
| 2016/0281039 | A1 | 9/2016 | Narasimhan et al. | |
| 2016/0282040 | A1 | 9/2016 | Wenji et al. | |
| 2017/0102181 | A1 | 4/2017 | Arjona Esteves | |
| 2017/0113870 | A1 | 4/2017 | Looker | |
| 2017/0314851 | A1 | 11/2017 | Alexander | |
| 2017/0356686 | A1 | 12/2017 | Xue et al. | |
| 2018/0040795 | A1 | 2/2018 | Lam et al. | |
| 2018/0087812 | A1 | 3/2018 | Armstrong | |
| 2018/0105410 | A1 | 4/2018 | Kim et al. | |
| 2018/0106533 | A1 | 4/2018 | Auchnor | |
| 2018/0164034 | A1 | 6/2018 | Banks | |
| 2018/0235392 | A1 | 8/2018 | Yuki et al. | |
| 2018/0240229 | A1 | 8/2018 | Yuki | |
| 2018/0252446 | A1 | 9/2018 | Place | |
| 2019/0154313 | A1 | 5/2019 | Verellen | |
| 2020/0224964 | A1 | 7/2020 | Alexander | |
| 2021/0063081 | A1 | 3/2021 | Tachibana et al. | |

FOREIGN PATENT DOCUMENTS

| | | | | |
|---|---|---|---|---|
| CN | 105466152 | A | 4/2016 | |
| CN | 106679331 | A | 5/2017 | |
| DE | 102006021459 | A1 | 11/2007 | |
| EP | 2426575 | A2 | 3/2012 | |
| EP | 3301381 | A1 | 4/2018 | |
| FR | 2900724 | A1 | 11/2007 | |
| GB | 2604912 | A * | 9/2022 | F25D 31/007 |
| JP | 2001041630 | A | 2/2001 | |
| JP | 2003106728 | A | 4/2003 | |
| JP | 2004212029 | A | 7/2004 | |
| KR | 20130097920 | A | 9/2013 | |
| KR | 1020200006670 | A | 1/2020 | |
| WO | 2011150018 | A1 | 12/2011 | |
| WO | 2017137774 | A2 | 8/2017 | |
| WO | WO-2017191694 | A1 * | 11/2017 | F25B 21/04 |
| WO | 2020055553 | A1 | 3/2020 | |
| WO | 2021096807 | A1 | 5/2021 | |

OTHER PUBLICATIONS

Fargo Controls, Inc. (Nov. 6, 2008). Operating Principles for Inductive Proximity Sensors. Retrieved Aug. 2, 2019, from https://www.fargocontrols.com/sensors/inductive_op.html (Year: 2008).

Ferrotec. (Nov. 13, 2008). Ferrotec Multi-stage Deep Cooling Peltier Thermoelectric Cooler Modules. Retrieved Aug. 2, 2019, from https://thermal.ferrotec.com/products/peltier-thermoelectric-cooler-modules/deep-cooling/ (Year: 2008).

Henrik Mensing, Danish International Searching Authority, International Search Report and Written Opinion, counterpart PCT Application No. PCT/DK2022/050115, mailed Aug. 23, 2022, 19 pages total.

* cited by examiner

APPARATUS FOR BEVERAGE CONTAINER TEMPERATURE CONTROL

CROSS-REFERENCE TO RELATED APPLICATIONS

This application claims the benefit of U.S. application Ser. No. 17/751,745, filed May 24, 2022, which is incorporated by reference herein in its entirety, which in turn claims the benefit of U.S. Provisional Application No. 63/194,275, filed May 28, 2021, to which this application also claims benefit and which is also incorporated by reference herein in its entirety.

FIELD

The present disclosure relates to devices and systems for controlling the temperature of containers for beverages. More particularly this disclosure pertains to systems and devices for chilling a container having a beverage inside or for maintaining such a container at a suitable temperature.

BACKGROUND

One important consideration in the enjoyment of beverages such as wine, beer, and soft drinks is the temperature of the beverage when it is being imbibed. There are numerous devices and systems for cooling a beverage or maintaining a beverage at a cool temperature so that it is ready for consumption at the proper temperature. These devices range from the extremely simple to the more sophisticated. In general, it is desirable to have a device or system which is portable, cools relatively quickly, and is lightweight. For devices that run on electricity, is desirable to have a relatively low power consumption especially if is desired for the unit to be portable and capable of running on a portable power source such as batteries.

With all of this taken into account, there is a need for a beverage cooler which is portable, cools efficiently, and has relatively low power consumption.

SUMMARY

The following presents a concise summary of one or more embodiments in order to provide a basic understanding of the embodiments. This summary is not an extensive overview of all contemplated embodiments and is not intended to identify key or critical elements of all embodiments nor set limits on the scope of any or all embodiments. Its sole purpose is to present some concepts of one or more embodiments in a simplified form as a prelude to the more detailed description that is presented later.

In accordance with one aspect of an embodiment there is disclosed an apparatus for controlling a temperature of a beverage container, the apparatus comprising a housing having an upper portion and a lower portion, the upper portion including a receptacle adapted to receive the beverage container, a thermoelectric element positioned in the lower portion, the thermoelectric element having a first side at a first temperature and a second side at a second temperature lower than the first temperature, the second side being in thermal communication with the receptacle, the thermoelectric element being configured to operate at a first voltage, a pin fin heat sink in thermal communication with the first side, at least one battery positioned in the lower portion and electrically connected to the thermoelectric element to provide power to the thermoelectric element, the battery having an output voltage greater than the first voltage, and a voltage converter adapted to down convert the output voltage of the at least one battery to the first voltage and for supplying the first voltage to the thermoelectric element.

The upper portion of the housing may include structure defining an integral handle. The lower portion of the housing may include a touch sensitive dot matrix display. The touch sensitive dot matrix display may display a set temperature The touch sensitive dot matrix display may be configured to enable control of a set temperature. The apparatus may further comprise at least one temperature sensor for measuring at least one measured temperature in the receptacle. The lower portion of the housing may include a touch sensitive dot matrix display displaying the at least one measured temperature. The pin fin heat sink may be positioned in the lower portion.

The lower portion may include air outlets at a base of the lower portion and air inlets positioned above and separated from the air outlets by a barrier and the fan may be arranged to draw air in through the air inlets, force the air through the heat sink, and exhaust the air passed through the heat sink out through the air outlets, with the air inlets being positioned above the air outlets when the apparatus is oriented vertically.

The apparatus may further comprise a detector arranged to detect whether a container is present in the receptacle and the apparatus may be configured to place the apparatus in a low power mode if no container has been present in the receptacle for more than a predetermined period of time. The apparatus may further comprise a detector arranged to detect a characteristic of a container placed in the receptacle and wherein the apparatus selects the second temperature based on the characteristic. The apparatus may further comprise a volume detector arranged to detect a detected volume of liquid in a container inserted into the cradle and an indicator adapted to provide an indication of the detected volume. The apparatus may further comprise a temperature detector arranged to detect a detected temperature of the container and an indicator adapted to provide an indication of the detected temperature.

The apparatus may further comprise a touch sensitive dot matrix display including a temperature selector arranged to select the second temperature as a set temperature and an indicator adapted to provide an indication of the set temperature. The apparatus may further comprise a communications module arranged to receive control data from an external device. The apparatus may further comprise a touch sensitive dot matrix display for inputting control data.

The apparatus may further comprise a sensor provided to sense the temperature of incoming air to the pin fin heat sink. The apparatus may further comprise a sensor provided on the housing to measure at least one of ambient temperature, humidity, light intensity, wind speed, and atmospheric pressure. The apparatus may further comprise a printed circuit board assembly and the pin fin heat sink may be arranged to cool the at least one battery and the printed circuit board assembly.

The apparatus may further comprise a tip tilt detection sensor arranged to detect tipping or tilting of the housing. The apparatus may further comprise a communication interface including a device for communicating data to or from the apparatus and an outside device.

According to another aspect of an embodiment there is disclosed an apparatus for controlling a temperature of a beverage container, the apparatus comprising a cylindrical housing having an upper portion and a lower portion, the upper portion including a cylindrical receptacle adapted to receive the beverage container, the cylindrical housing having a slanted upper rim defining a raised portion and an integral handle in the raised portion, a thermoelectric element positioned in the lower portion, the thermoelectric element having a first side at a first temperature and a second side at a second temperature lower than the first temperature, the second side being in thermal communication with the receptacle, the thermoelectric element being configured to operate at a first voltage, a pin fin heat sink in thermal communication with the first side, a fan arranged to ventilate the heat sink and positioned in the lower portion, at least one battery positioned in the lower portion and electrically connected to the thermoelectric element to provide power to the thermoelectric element, the battery having an output voltage greater than the first voltage, and a voltage converter adapted to down convert the output voltage of the at least one battery to the first voltage and for supplying the first voltage to the thermoelectric element.

Further embodiments, features, and advantages of the subject matter of the present disclosure, as well as the structure and operation of the various embodiments, are described in detail below with reference to accompanying drawings.

BRIEF DESCRIPTION OF THE DRAWINGS

The accompanying drawings, which are incorporated herein and form part of the specification, illustrate the methods and systems of embodiments of the invention by way of example, and not by way of limitation. Together with the detailed description, the drawings further serve to explain the principles of and to enable a person skilled in the relevant art(s) to make and use the methods and systems presented herein. In the drawings, like reference numbers indicate identical or functionally similar elements.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art based on the teachings contained herein.

DETAILED DESCRIPTION

Various embodiments are now described with reference to the drawings. In the following description, for purposes of explanation, numerous specific details are set forth in order to promote a thorough understanding of one or more embodiments. It may be evident in some or all instances, however, that any embodiment described below can be practiced without adopting the specific design details described below. In other instances, well-known structures and devices are shown in block diagram form in order to facilitate description of one or more embodiments.

The embodiment(s) described, and references in the specification to "one embodiment," "an embodiment," "an example embodiment," "an exemplary embodiment," etc., indicate that the embodiment(s) described may include a particular feature, structure, or characteristic, but not every embodiment necessarily includes the particular feature, structure, or characteristic. Moreover, such phrases are not necessarily referring to the same embodiment. Further, when a particular feature, structure, or characteristic is described in connection with an embodiment, it is understood that it is within the knowledge of one skilled in the art to effect such feature, structure, or characteristic in connection with other embodiments whether or not explicitly described.

Figure 1:
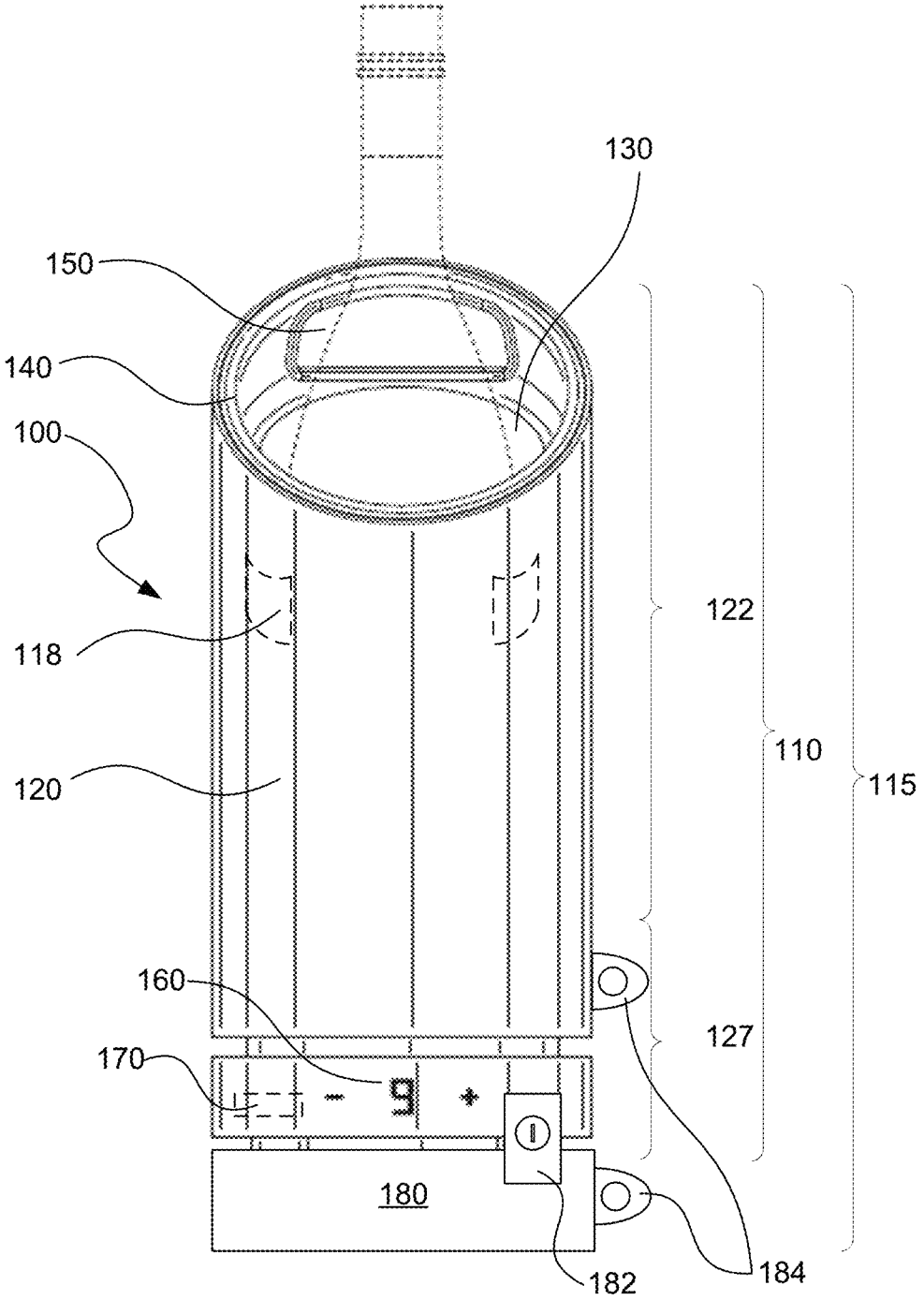
FIG. 1 is a perspective view of a beverage container temperature control system according to one aspect of an embodiment.

With respect to FIG. 1, there is shown a beverage container temperature control system 100 which includes a housing 120. An upper portion 122 of the housing 120 defines a beverage container receptacle 130. The upper portion 122 and a lower portion 127 together make up a beverage cooling unit 110. The beverage cooling unit 110 and a charging base (station) 180 described more fully below make up a beverage cooling system 115. Although these elements are designated with the term "cooling" this is simply an example and one of ordinary skill in the art will understand that the cooling system 115 and its components can also be adapted to warm a beverage and in general provide the ability to control a temperature of a beverage.

As can be seen, according to an aspect of an embodiment, the housing 120 is generally cylindrical with the cylinder being truncated with a slanted rim 140 at the top. The slanted rim 140 defines a beverage container insertion port. The slanted rim 140 makes it easier to insert a beverage container into, and remove a beverage container from, the beverage container receptacle 130. The beverage receptacle may be made of a thermally conductive material such as aluminum. According to another aspect of an embodiment the interior volume of the beverage container receptacle 130 of the beverage cooling unit 110 is provided with one or more light sources 118 to illuminate a beverage container placed in the beverage container receptacle 130 from the bottom and/or sides.

The slanted rim 140 creates a geometry in which a front portion of the housing 120 and receptacle 130 are lower than a rear portion of the housing 120 and the receptacle 130. The rear portion of the housing 120 below the higher portion of the slanted rim 140 includes an aperture 150 serving as an integral handle. This geometry also permits active cooling of more surface area of the beverage container, in particular, the portion of the beverage container adjacent the rear portion of the receptacle 130 while simultaneously obtaining the aesthetic benefit of displaying more of the beverage container.

The lower part or base 127 of the housing 120 contains electrical and electronic components such as a printed circuit board assembly for controlling a temperature in the beverage container receptacle 130. As will be explained more fully below, positioning these components in the base of the housing 120 makes the system 100 less likely to topple by lowering its center of gravity. According to an aspect of an embodiment, the lower part 127 of the housing 120 may also include a display 160 for displaying a temperature which may be a set temperature or an actual temperature. A control 170 such as a slide switch, shown in phantom as it may not be visible, may be included for setting a temperature.

As mentioned, FIG. 1 also shows a charging base (station) 180 described in more detail below which is provided to charge a portable power source in the lower portion 127 such as one or more batteries or battery packs, the terms "battery" and "battery pack" being used interchangeably throughout this specification.

According to another aspect of an embodiment the beverage cooling unit 110 and the charging station 180 can be secured to one another with a locking arrangement 182. Also, the charging station 180 and or the beverage cooling unit 110 may be provided with a security eyelet 184 dimensioned to receive a cable or strut so that the overall beverage cooling system 115 can be secured against theft with a lock that secures the cable to furniture or a wall or floor in an unsecured location such as a hotel room. As another security feature, the beverage cooling system 115 can also be supplied with GPS tracking so that it can detect and report its position as described below.

Figure 2A:
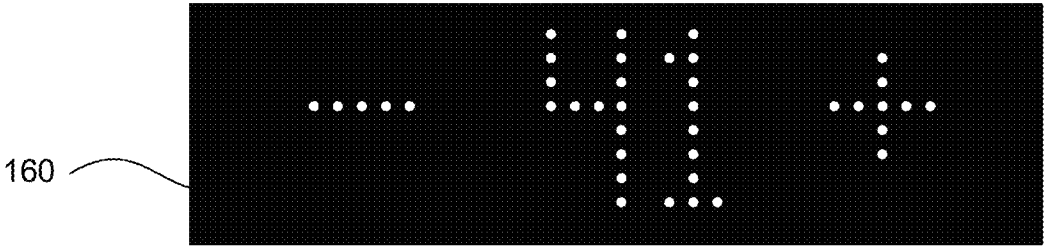
FIGS. 2A, 2B, and 2C are illustrations of touch sensitive displays such as might be used according to an aspect of an embodiment.

According to another aspect of an embodiment the controls and display 160 on the beverage cooling unit 110 can be configured to provide a multiple function display and control interface using a very small number of elements. For example, the display and control interface can be configured as a low resolution dot matrix display capable of simultaneously displaying, for example, a plus sign, a temperature of the interior of the receptacle, and a minus sign as shown in FIG. 2A. The plus or minus sign can be caused to pulsate to indicate whether the temperature inside the receptacle is increasing or decreasing, for example, with the plus sign pulsating if the temperature is increasing and the minus sign pulsating if the temperature is decreasing. This pulsation can be caused to stop and transition to a steady illumination or no illumination once a set temperature has been attained.

The position of the plus sign and the minus sign can also be provided with a position sensitive touch sensor such that simultaneously depressing positions such as the position of the minus sign and the position of the plus sign can initiate an operation such as displaying battery status and or changing a temperature display between degrees Celsius and degrees Fahrenheit. Simultaneously depressing positions such as the position of the minus sign and the position of the plus sign for more than a predetermined period of time, e.g., 30 seconds, can perform a control function such as, for example, resetting or rebooting the beverage control unit. As another example, the position sensitive touch sensor can be configured so that covering the entire width of the display for example with the palm of the hand for more than a predetermined period of time, e.g., 30 seconds, resets the touch display.

Figure 2B:
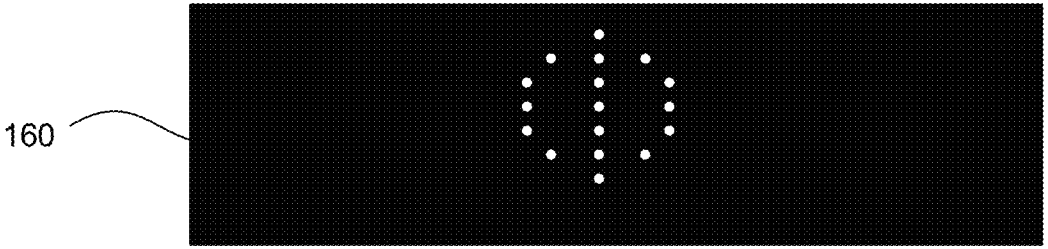

According to another aspect of an embodiment an ON/OFF switch can be placed below the dot matrix touch display not only for improved aesthetics but also to enable reduction of the number of layers on the printed circuit board assembly. The dot matrix display can be configured to show an icon representing the switch as shown in FIG. 2B.

Figure 2C:
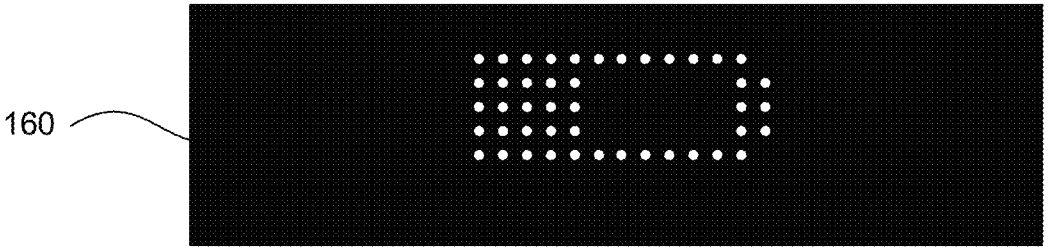

According to another aspect of an embodiment the display can also provide a battery life indicator as shown in FIG. 2C. This battery life indicator can be configured to remain on even when the beverage cooling unit is switched off.

Overall, the dot matrix display can be configured to display many different types of types of information with a minimal aesthetic impact.

According to another aspect of an embodiment the touch display may be configured to control a level of illumination of the dot matrix display in accordance with whether the display is being or has recently been touched. For example, the touch display can be configured to increase its illumination when touched and to decrease its illumination when it is no longer being touched or has not been touched for greater than a predetermined amount of time. According to another aspect the beverage cooling unit 110 (FIG. 1) can include a sensor arranged and configured to sense an ambient illumination level and the control unit can control the level of illumination of the touch display based on the sensed ambient illumination level, for example, making the display brighter in full daylight and making the display dimmer when the ambient light is dimmer.

Figure 3A:
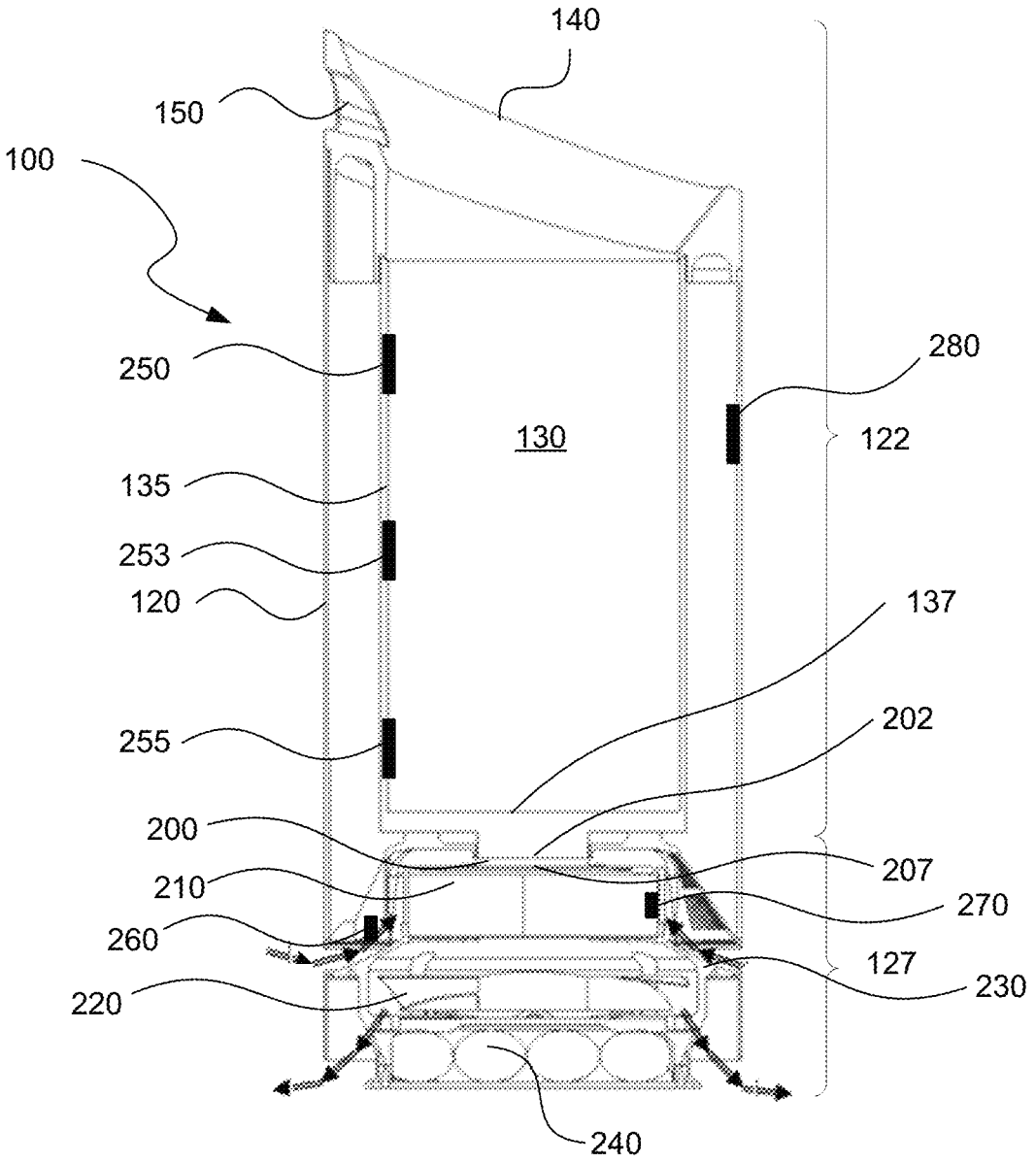
FIG. 3A is a cutaway view of a beverage container temperature control system according to one aspect of an embodiment.

FIG. 3A is a cutaway view of the beverage container temperature control system 100 of FIG. 1. As can be seen, the housing 120 surrounds the interior receptacle 130. According to another aspect of an embodiment the exterior (class-A) surfaces of the beverage cooling unit 110, e.g., the housing 120, are constructed of multiple plastic parts which are double snap fit to one another without screws or other fasteners to enable easy disassembly of the beverage cooling unit and so recyclability of its components.

As described below, the wall 135 of the receptacle 130 serves as a cold sink for a temperature control element 200. The temperature control element 200 may be a cooling element, and, more specifically, a thermoelectric cooler such as a Peltier element. Using a Peltier element as an example, the temperature control element 200 has a cold side 202 and a hot side 207. The cold side 202 of the temperature control element 200 is in thermal contact with the bottom surface 137 of the receptacle 130 which, as mentioned, with the integral wall 135 functions as a cold sink for the temperature control element 200. The hot side 207 of the temperature control element 200 is in thermal communication with a heat sink 210. The heat sink 210 is cooled by an air flow indicated by the inwardly flowing arrows. The air flows through the front and back of the heat sink 210 then exits the compartment containing the heat sink 210 as indicated by the outwardly flowing arrows. The air is driven by a fan 220. A parting wall 230 separates the area where intake air is drawn in and the area where hot air is expelled.

Also shown in FIG. 3A, a portable power source 240, for example, battery cells, supplies power to the fan 220 and to the temperature control element 200. The unit may also include, for example in the fan compartment, provision for gyroscopic stabilization. In some embodiments the fan 220 itself may be adapted to provide some degree of gyroscopic stabilization, for example, by the weight distribution of the fan blades. According to another aspect of an embodiment the fan 220 is arranged to cool not only the thermoelectric element(s) 200 and the heat sink 210 but also to cool the system electronics including the printed circuit board assembly and the battery.

FIG. 3A also shows possible locations for various sensors that may be provided in an embodiment. For example, a sensor 250 may be used to sense a temperature of the beverage container receptacle 130 at an upper location. A sensor 253 may be provided to sense a temperature in the beverage container receptacle 130 at a mid-level location. A sensor 255 may be provided to sense the temperature of the beverage container receptacle 130 at or near the bottom of the beverage container receptacle 130. In addition, a sensor 280 may be provided to sense the temperature of the incoming ambient air to the heat sink 210. A sensor 280 may be provided on the housing 120 to measure ambient temperature, humidity, light intensity, wind speed, and atmospheric pressure.

In an embodiment, the sensor 250 may also be configured to sense and send a signal indicative of the presence or absence of a beverage container in the beverage container receptacle 130. According to another aspect of an embodiment the control system is configured to receive the signal from the sensor 250 and to transition the system to lower power state, including an off state, in which the system uses less or no power, when the signal from the sensor 250 indicates that no container has been present in the beverage container receptacle 130 for more than a predetermined duration, e.g., five minutes.

Figure 3B:
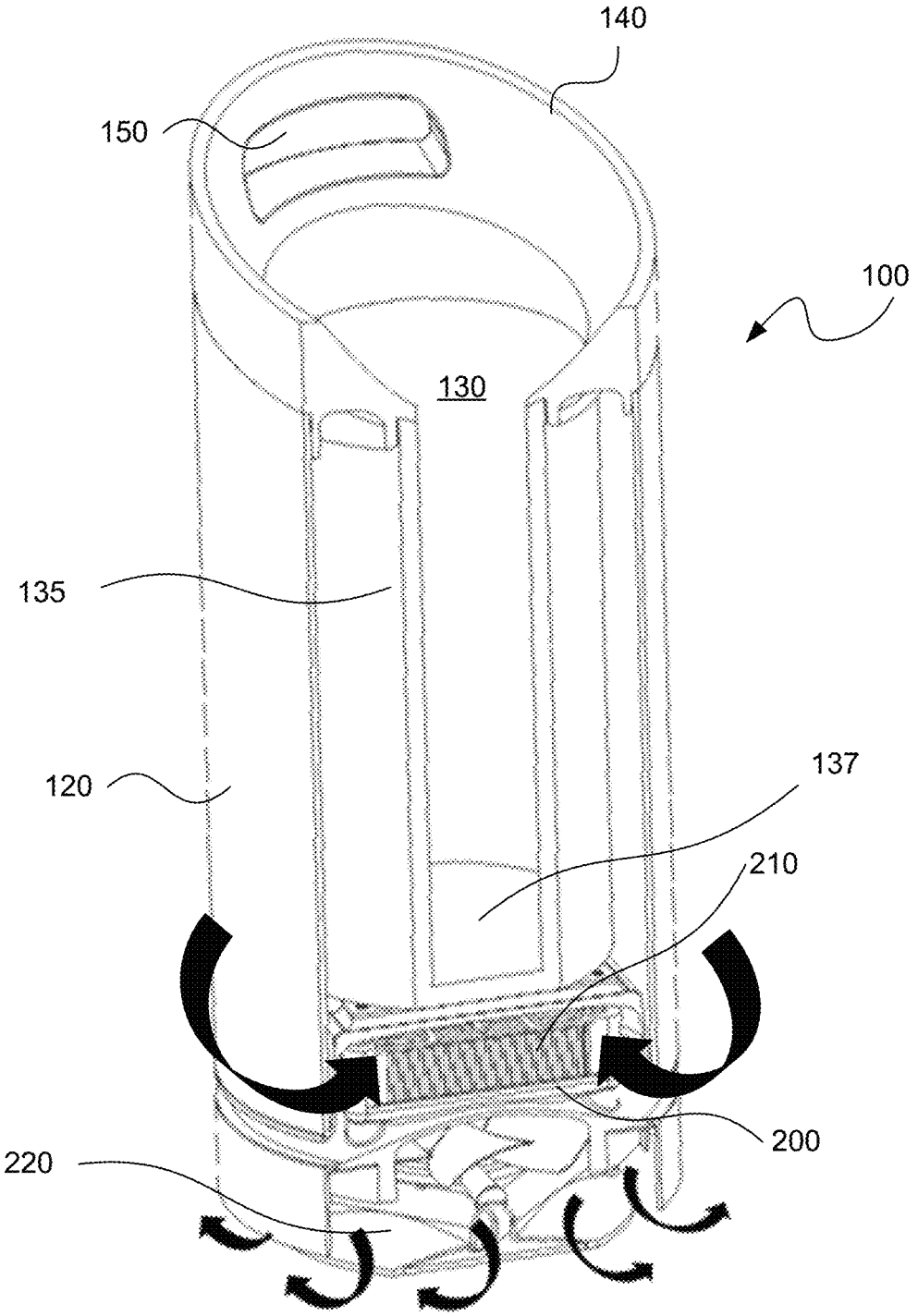
FIG. 3B is a partially cutaway perspective view of a beverage container temperature control system according to one aspect of an embodiment.

FIG. 3B is a partially cutaway perspective view of the beverage container temperature control system 100. As can be seen, according to an aspect of an embodiment, warm air is expelled downward from the fan 220 in a 360° ring as indicated by the outflowing arrows Ambient air is drawn in through the front and rear of the heat sink 210 as indicated by the inflowing arrows. Also better visible in FIG. 3B is the wall 135 of receptacle 130 including base wall 137 of receptacle 130. As mentioned, these walls may be made of a thermally conductive material such as aluminum.

Figure 3D:
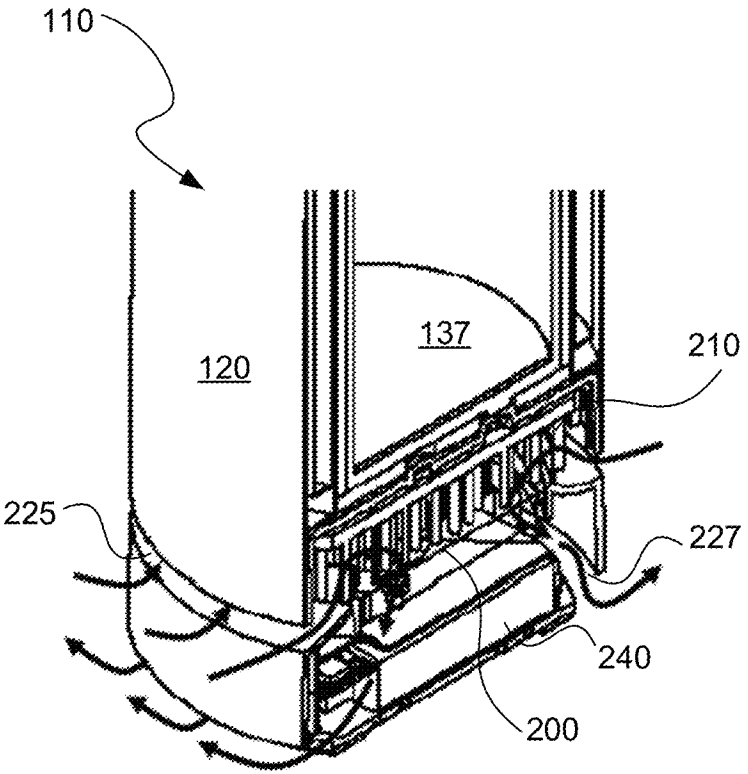
FIG. 3D is a partially cutaway perspective view of a beverage container temperature control system according to one aspect of an embodiment.
Figure 3C:
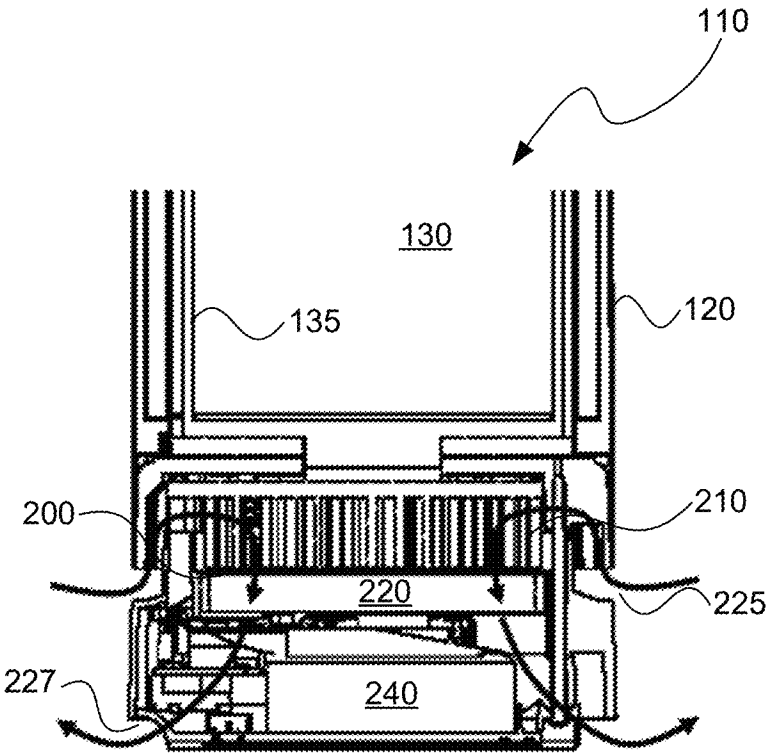
FIG. 3C is a cross sectional view of a beverage container temperature control system according to one aspect of an embodiment.

FIG. 3C is a cross section of a lower portion of the beverage cooling unit 110 and FIG. 3D is a partially cutaway perspective view of a portion of the beverage cooling unit 110. As is visible in FIG. 3C, the lower portion of the beverage cooling unit 110 has a beverage container receptacle 130 defined by an internal wall 135. Below and in thermal communication with the wall 135 the cold side of the thermoelectric element 200. In accordance with an aspect of an embodiment, the heat sink 210 is configured as a pin fin heat sink. Pin fin heat sinks are particularly efficient in impingement cooling in this arrangement in which the fan 220 placed adjacent the array of pins of the heat sink blows air directly on the surface. The pin fin structure for impingement cooling lowers the thermal resistance. Impingement cooling also distributes the air evenly along the heat sink. The pin fin heat sink is also in thermal communication with the hot side of the thermoelectric element 200 positioned above the fan 220. Also shown in FIG. 3C is a power portable power source 240, for example, a battery.

As indicated by the arrows in in FIG. 3C the fan 220 is configured to create a flow pattern in which air intakes 225 are positioned above the air outlets 227. The arrows in FIG. 3D provide an additional view of the flow pattern of air into and out of the bottom portion of the beverage cooling unit 110. Again, as can be seen, air is taken in in a 360° pattern and then expelled in a 360° pattern. According to another aspect of an embodiment the position of air intakes 225 and air outlets 227 are chosen to facilitate a 360° airflow through the pin fin array. Also, according to another aspect, the air intakes 225 are positioned to be gravitationally above the air outlets 227 when the beverage control unit is in its operational orientation (e.g., upright) so that the air intakes 225 are less prone to draw in particulate contaminants (e.g., dust), in particular, particulate contaminates such as may be stirred up by the outflow of air from the air outlets 227.

As mentioned, according to another aspect of an embodiment the beverage cooling unit 110 is provided with a pin fin heat sink 210 to permit efficient dissipation of heat generated by the thermoelectric temperature controller 200. As seen, the heat sink 210 is configured as a base and an array of pin-shaped fins extending out from the base. The pin fin heat sink 210 has a generally circular shape to facilitate accommodation of the heat sink 210 in a beverage cooling unit 110 having a generally circular cross section in the section of the beverage cooling unit 110 housing the heat sink 210. The generally circular shape of the pin fin heat sink 210 also permits a 360° airflow through the pin fin array thus promoting efficient cooling.

Figure 4A:
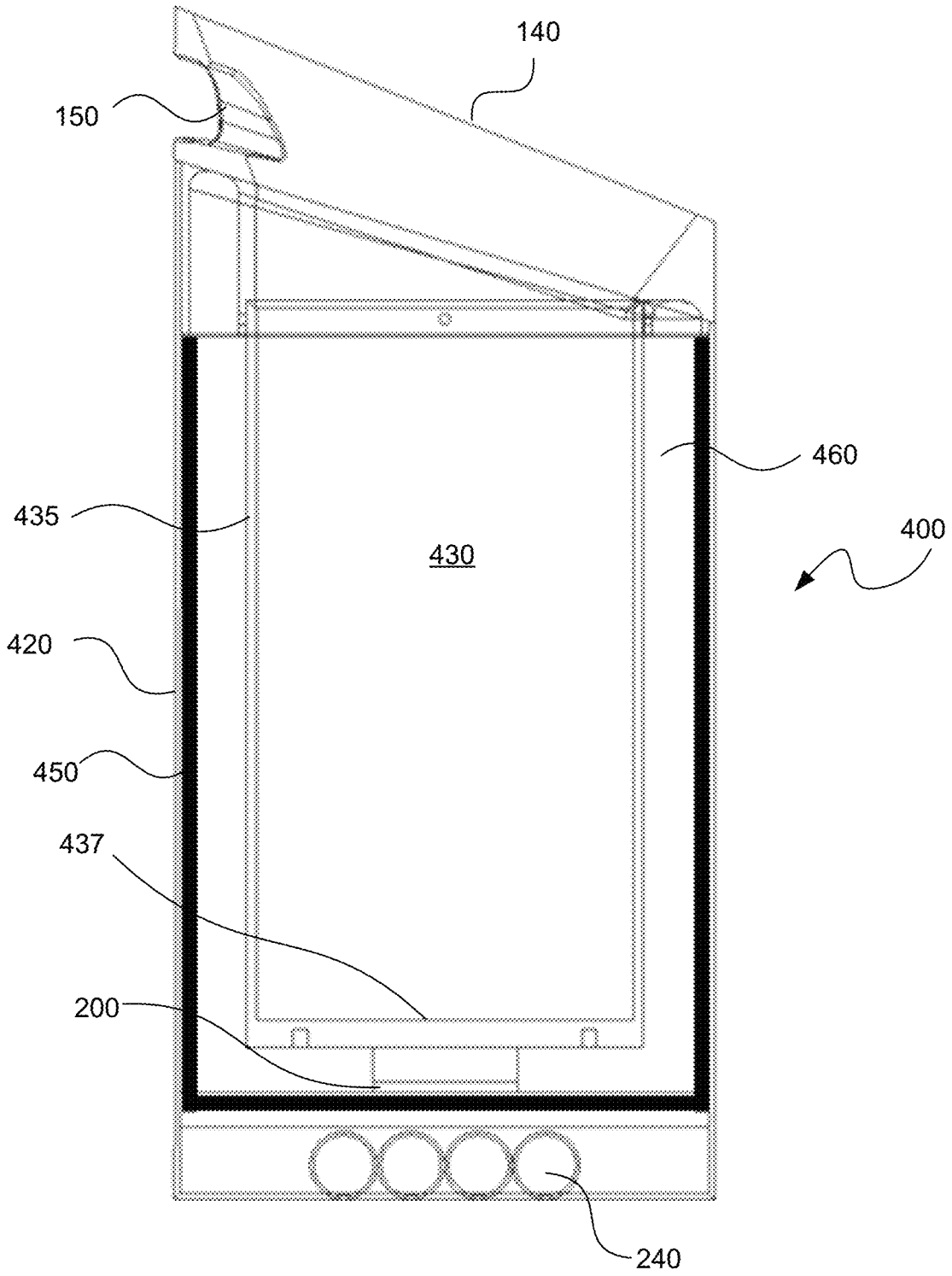
FIG. 4A is another cutaway view of a beverage container temperature control system according to one aspect of an embodiment.

FIG. 4A is a cutaway sideview of a beverage container temperature control system 400 according to another aspect of an embodiment. In order to avoid the power drain caused by a fan, and also to avoid noise and vibration which may be caused by a fan, the embodiment of FIG. 4A avoids the use of a fan by employing the housing 420 as a heat sink. The cold side of the Peltier unit 200 is in direct thermal communication with the bottom wall 437 and side wall 435 of the container receptacle 430. The hot side of the Peltier unit 200 is in thermal contact with a heat sink made up at least in part by the housing 420. Heat pipes 450 can be used in thermal contact with housing 420 to provide better heat transfer. A vacuum chamber 460 may be interposed between the walls of the container receptacle 430 in the housing 420 to provide thermal insulation between the heat sink in the cold sink. A phase change material may be placed in the space between the walls of the container receptacle 430 in the housing 420 to provide thermal insulation between the heat sink in the cold sink.

Figure 4C:
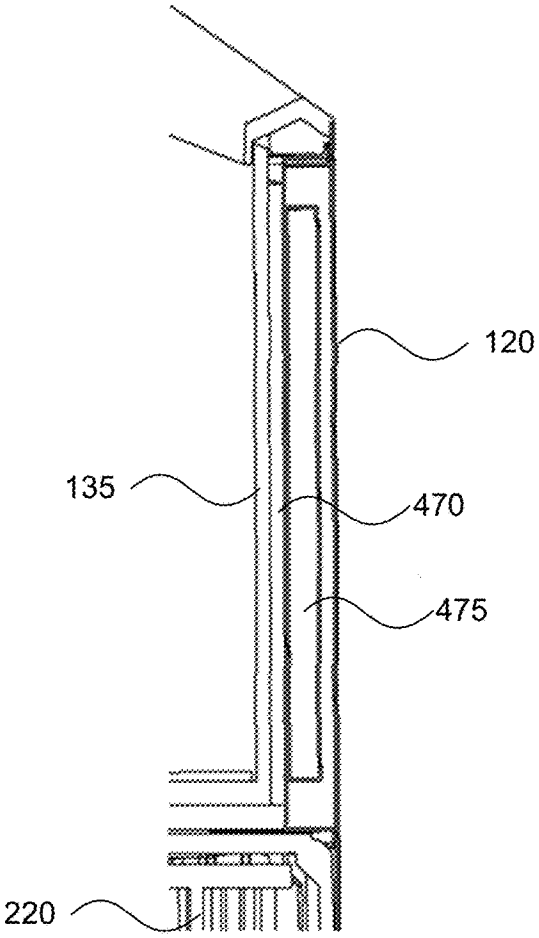
FIG. 4C is a cross sectional enlarged view of a section of the beverage container temperature control system of FIG. 4B.
Figure 4B:
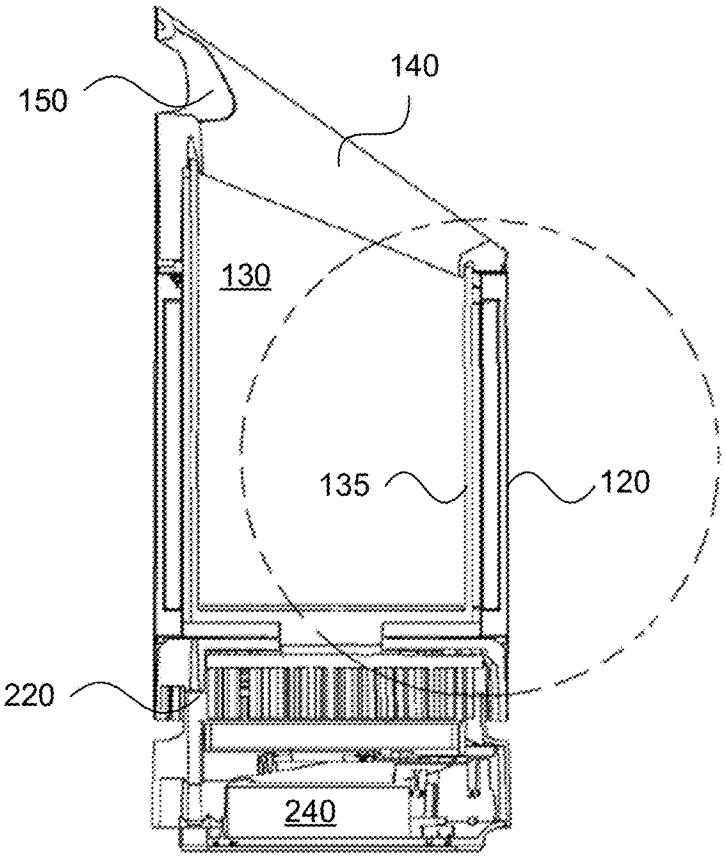
FIG. 4B is a cross sectional view of a beverage container temperature control system according to one aspect of an embodiment.

According to another aspect of an embodiment the wall 135 acting as a cold sink is thermally insulated from the housing 120 of the beverage cooling unit 110 by an air/vacuum insulating gap and by an insulating layer with the insulating layer being provided by a wrapping of insulating tape as shown in FIGS. 4B and 4C. In more detail, as shown in FIG. 4C, which is an enlarged portion of the area enclosed by the broken circle in FIG. 4B, the wall 135 acting as a cold sink is insulated from the housing 120 by a vacuum insulation 475 and a layer of foam insulation 470. The foam insulation can be efficiently and expeditiously provided by using by wrapping the cold sink 135 in a layer of insulating tape.

Figure 5A:
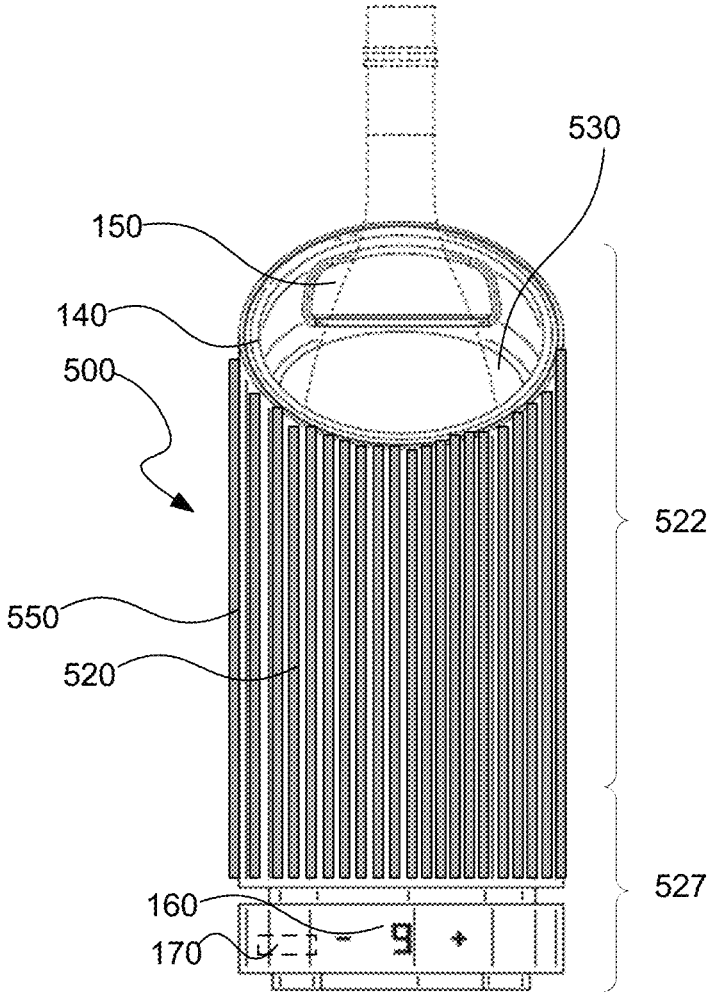
FIG. 5A is a perspective front view of a beverage container temperature control system according to one aspect of an embodiment.
Figure 5B:
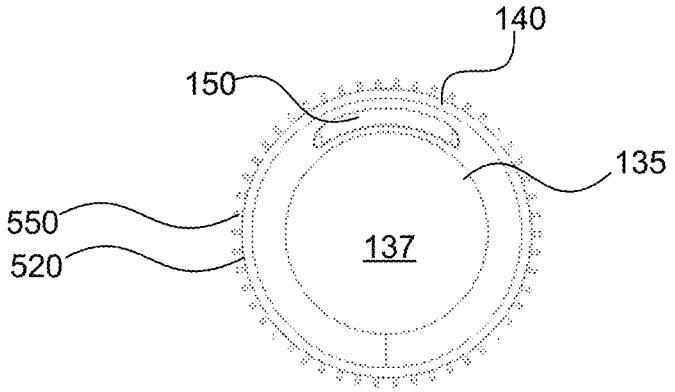
FIG. 5B is a top view of the embodiment of FIG. 5A.

FIGS. 5A and 5B show a beverage container temperature control system 500 in accordance with another aspect of an embodiment. FIG. 5A is a front view of the beverage container temperature control system 500. As can be seen, the outer housing 520 of the beverage container temperature control system 500 is provided with a set of fins 550 to promote heat radiating away from the outer housing 520. Such an implementation may be particularly advantageous in embodiments which a fan is not used and the outer housing 520 is used as a heat sink. FIG. 5B is a top view of the embodiment of FIG. 5A. As can be seen, in an embodiment the fins are arranged as elongated elements positioned parallel to an axis of the cylindrical housing.

Figure 6B:
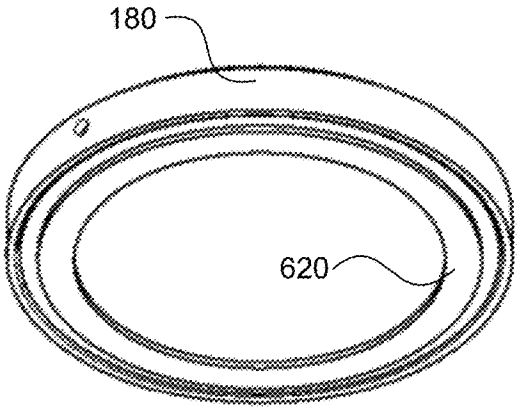
FIGS. 6A and 6B are an exploded view and a perspective view, respectively, of a charging station according to one aspect of an embodiment.
Figure 6A:
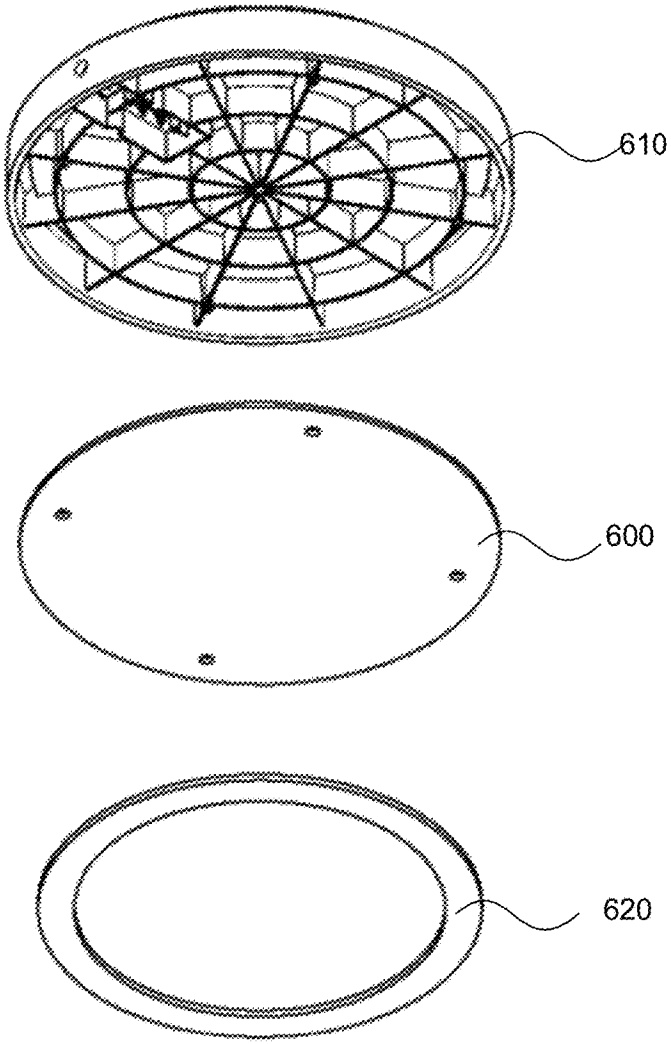

According to another aspect of an embodiment, as shown in FIGS. 6A and 6B, the charging station 180 may also be provided with a weight 600, for example in the form of a steel plate placed inside a charging station housing 610 to lower the center of gravity of the charging station 180 so it is more stable in its upright position. The charging station 180 can additionally be provided with a footing 620 made of an elastomeric material such as rubber. The final assembly in accordance with this aspect of an embodiment is shown in FIG. 6B.

Figure 7A:
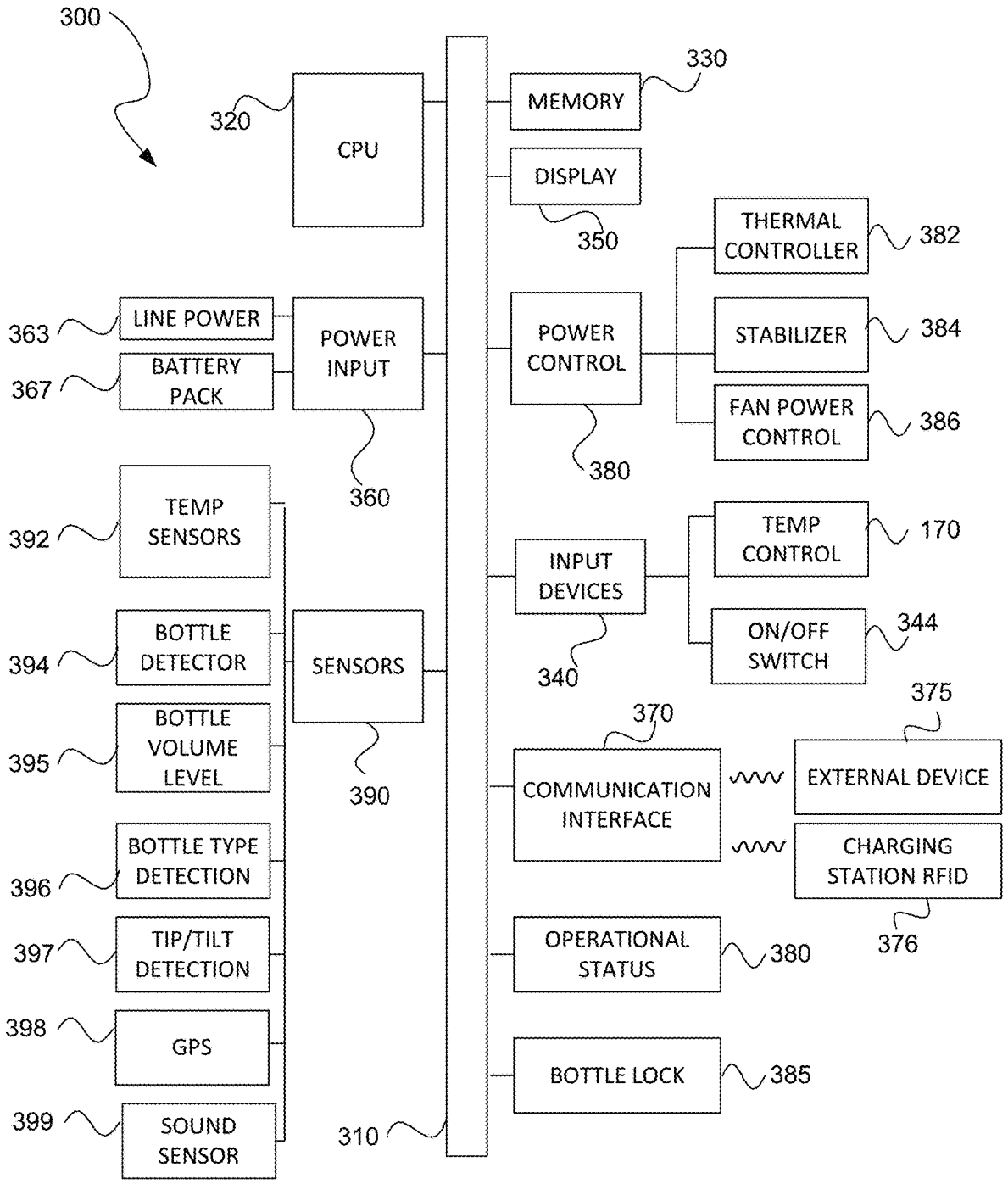
FIG. 7A is a circuit block diagram of a control system for a beverage container temperature control system according to one aspect of an embodiment.

The various sensors described above make up part of an overall control system 300, one possible arrangement for which is included in the functional block diagram shown in FIG. 7A. As shown, the control system 300 may include a suitably programmed CPU 320 and a memory 330 for storing instructions and data connected to one another by a bus 310.

The input devices 340 may include a touch screen such as the touch sensitive dot matrix display described above or any other manual user interface devices used for controlling operation of beverage container temperature control system. Also connected by the bus 310 may be one or more displays 350 which may include, for example, the temperature display 160 (FIG. 1) which may be toggled between a set temperature and a measured temperature. The displays 350 may include more complicated visual displays such as a small screen which may be a touch screen.

The input devices 340 which may include one or more switches or controllers, temperature control switch 170 (FIG. 1) as well as a physical on/off switch 344. The control system 300 may also include sensors 390 which may include temperature sensors 392 which in turn may include temperature sensors 250, 253, 255, 269, 270, and 280 (FIG. 2). The sensors 390 may also include a container detector 395 for detecting the physical presence of a container in the receptacle, a container volume level detector 395 which detects how much beverage is still in the container, a container type detection sensor 396 which can read the barcode on the container to determine what type of beverage is in the container and a tip tilt detection sensor 397 which can detect when the unit is tipping or tilting. The control system 300 may also include an operational status module 380 which determines the operational status of the unit and a bottle lock module 385 which can control a bottle lock to lock the bottle in place in receptacle when, for example, the unit is being transported with a bottle inside of it. The control system 300 can also be supplied with GPS tracking module 398 so that the system can detect and report its position.

According to another aspect of an embodiment the beverage cooling unit can be provided with a sound sensor 399 (e.g., microphone) to determine an ambient sound level and to adjust the operation of noise-generating components of the beverage cooling unit such as the fan to reduce the level of generated noise when the ambient sound level is relatively low and to permit noise generating components to operate at a higher level when the ambient sound level is relatively higher so that the generated noise is less likely to disturb a user.

The communication interface 370 may include any device for communicating data to or from the CPU 320 and an outside device. For example, the communications interface 370 may include a USB interface and/or or an Ethernet interface. The communications interface 370 may additionally or alternately include a wireless interface such as a Wi-Fi, Bluetooth, or an NFC interface.

A user interface can be implemented as software operating on a computer or as an application on a smart phone or tablet or other wireless communication device. To implement this, the communications interface 370 could be configured to interface with an external device 375 such as a wireless enabled device such as a computer, tablet, or cell phone. The user could use an application on the mobile device to control operation of the beverage container temperature control system. If the external device 375 is a wireless enabled device such as a computer, tablet, or cell phone, an application could be installed on the external device 375 and the user interface for the application could, for example, be a visual representation of a display with controls.

The control system 300 may also include various power control units 380 such as a thermal controller power control unit 382. The thermal controller power control unit 382 may use pulse width modulated control of the thermal control element 200 in which a duty cycle of pulses is used to control the average power supplied to the thermal control element 200. The power controller 380 may also a control 384 for a gyroscopic stabilizer if one is present. The power controller 380 may also include a fan power control 386 electrically connected to control operation of the fan assembly 220. The thermal controller 382 may also include provision for reversing the polarity of the thermal control element 200 so that it heats rather than cools or vice versa. This could be useful if an excess amount of ice accumulates at the receptacle 130 which may interfere with operation or even cause a container to become trapped in the receptacle 130.

The sensor 395 for sensing an amount or level of liquid in a container inserted into the receptacle 130 may operate optically or by determining net weight, for example for measuring usage patterns. The container level may be indicated by an indicator, for example, a column of LEDs illuminated up to the same level as the sensed level in the bottle, or may be relayed to be read remotely, e.g., by Bluetooth or Wi-Fi to a control device such as a smart phone running an app.

According to another aspect of an embodiment the sensor 395 includes a weight measuring element (e.g., a scale) that measures and provides a signal indicating a weight of a beverage container in the receptacle. The weight measurement signal can be used to determine whether a beverage container is present as indicated above. The weight measurement signal can also be used in conjunction with a display on the beverage cooling unit itself or on a GUI of an app running on a communication device linked to the beverage cooling unit by Bluetooth, NFC, Wi-Fi or the like to display the weight of any contents of the receptacle 130.

Figure 7B:
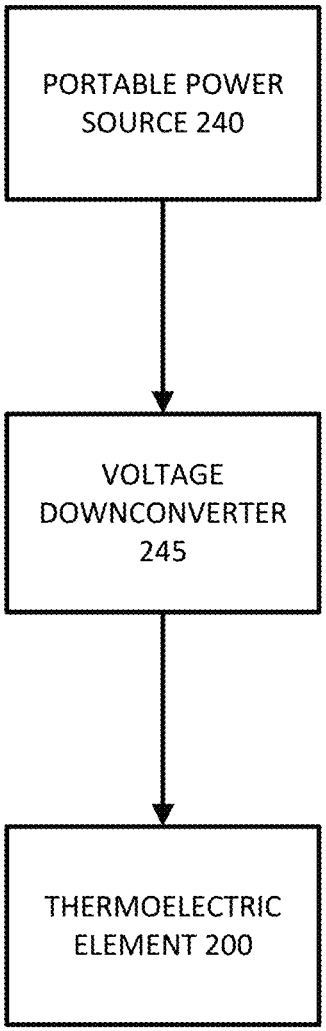
FIG. 7B is a functional block diagram of a voltage supply system according to one aspect of an embodiment.

The CPU 320 is also capable of selecting between multiple power inputs through a power input unit 360 which, for example, may be connected to line power 363 or a battery pack 367. According to another aspect of an embodiment, in order to increase system efficiency, the portable power source 240 such as a battery (including a battery pack) having an output voltage greater than the operational voltage of the thermal control unit 200 is used and then the voltage is downconverted (stepped down) by a voltage downconverter 245 to the voltage used by the thermal control unit element 200. The voltage downconverter 245 may be implemented as any known suitable device for decreasing voltage. In other words, the thermoelectric element is configured to operate at a first voltage and the portable power source 240 has an output voltage greater than the first voltage and the voltage downconverter is adapted to down convert the output voltage of the portable power source 240 to the first voltage and supplies the first voltage to the thermoelectric element as shown in FIG. 7B.

As mentioned, the CPU 320 may also be connected by the bus 310 to an operational status sensor 380 to determine, for example, operational temperature, an amount of time the device has been operated for purposes of scheduling maintenance or remaining battery life, and so on.

Figure 8A:
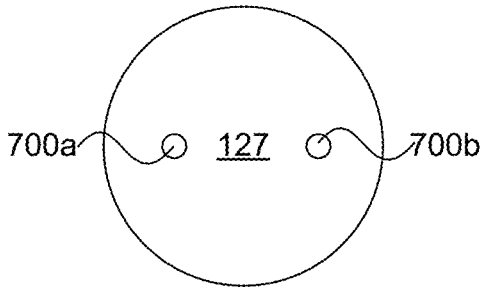
FIG. 8A is a bottom view of a beverage container temperature control system according to one aspect of an embodiment.

FIG. 8A is a bottom view of the lower portion 127 of the beverage container temperature control system 100. As can be seen, the bottom surface of the lower portion 127 is provided with two contacts 700*a* and 700*b*. These are made of an electrically conductive material and are in electrical connection with circuitry inside of the unit for charging the batteries located in the lower portion 127. These contacts are preferably recessed slightly from the bottom surface of the lower portion 127 so as not interfere with the unit resting stably on a horizontal surface.

Figure 8B:
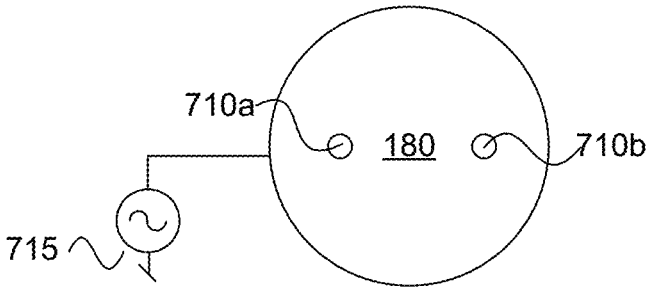
FIG. 8B is a top view of a charging base for a beverage container temperature control system according to one aspect of an embodiment.

FIG. 8B is a schematic diagram of the top view of a charging station or plate 180 for the beverage container temperature control system 100. The charging station 180 has two contacts 710*a* and 710*b* positioned to mate with the contacts 700*a* and 700*b* in the bottom surface of the lower portion 127. The charging station 180 contains circuitry needed to provide battery charging. It is intended to be connected to a source of line power 715. As an alternative, in accordance with an aspect of embodiment, the beverage temperature control unit 100 may include circuitry for contactless or inductive charging and which case the charging station 180 would be configured for contactless or inductive charging.

Figure 8C:
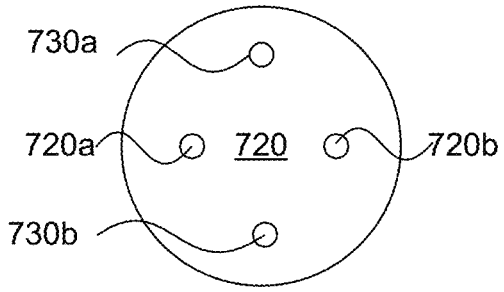
FIG. 8C is a top view of a battery pack for a beverage container temperature control system according to one aspect of an embodiment.

FIG. 8C is a diagram of a supplemental battery pack 720 with contacts 720*a* and 720*b* which mate with 700*a* and 700*b* to provide supplemental or auxiliary battery power for the beverage container temperature control unit 100. The supplemental battery pack 720 also contains contacts 730*a* and 730*b* intended to mate with contacts 710*a* and 710*b* in the charging station 180 so that the charging station 180 can charge the supplemental battery pack 720.

In more detail, according to another aspect of an embodiment, the beverage cooling system is made up of a beverage cooling unit including a rechargeable battery (including a battery pack) and a charging station 180 that is adapted to receive the beverage cooling unit and to make an electrical connection with the rechargeable battery when the beverage cooling unit is docked in the charging station 180. According to another aspect of an embodiment the charging station 180 can include a power supply configured as a current limiting power supply unit to enable charging the battery while at the same time operating the beverage cooling unit and vice versa.

Figure 9B:
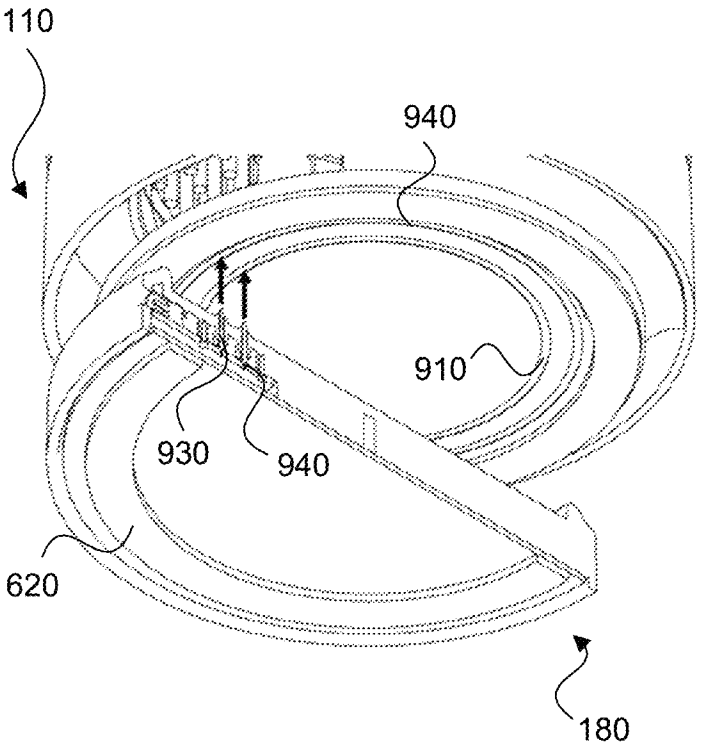
FIG. 9B is a partially cutaway perspective view of the embodiment of FIG. 9A.
Figure 9A:
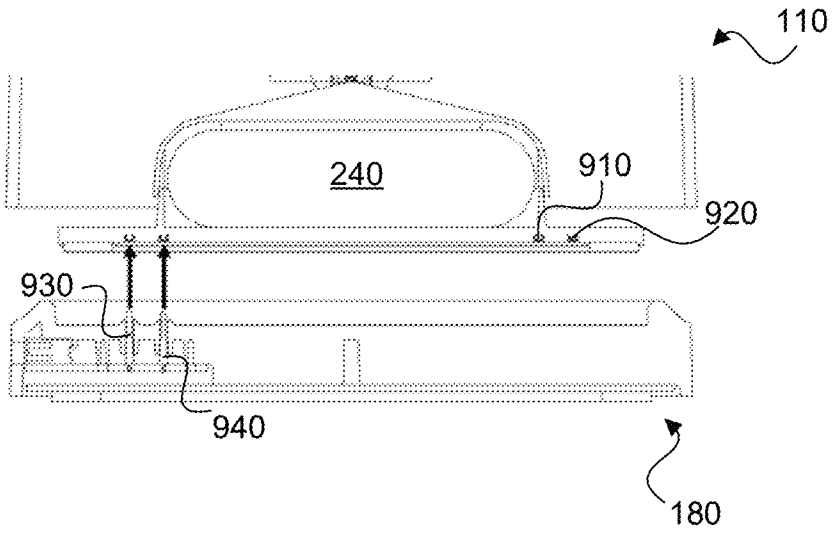
FIG. 9A is a cutaway view of an interface between a cooling unit and a charging station according to one aspect of an embodiment.

According to another aspect of an embodiment a bottom outside surface of the beverage cooling unit 110 may be provided with raised charging rings 910, 920 as shown in FIGS. 9A and 9B to permit simple charging without interfering with stable placement of the beverage cooling unit on a surface when it is not on the charging station, and, in particular, with stable placement of any elastic foot on the bottom of the beverage cooling unit on a surface. The charging station 180 may be provided with spring loaded connectors 930, 940 arranged to make an electrical connection with the beverage cooling unit charging rings 910, 920 when the beverage cooling unit 110 is docked in the charging station.

According to another aspect of an embodiment the beverage cooling unit 110 detects whether the charging station 180 is of an authorized or approved configuration to prevent damage to the beverage cooling unit as might be caused by interfacing with a charging station that provides improper charging voltage or amperage. The beverage cooling unit 110 can, for example, be provided with a radio-frequency identification (RFID) reader for example in communication interface 370 (FIG. 7) that senses and reads an RFID tag 376 provided in the charging station 180. The control unit in the beverage cooling unit can be configured to respond to the detection of an unapproved or unauthorized charging station by, for example, shutting down, disabling charging, and/or providing a visual or audible alert of an attempted interface with an unapproved or unauthorized charging station.

Figure 10:
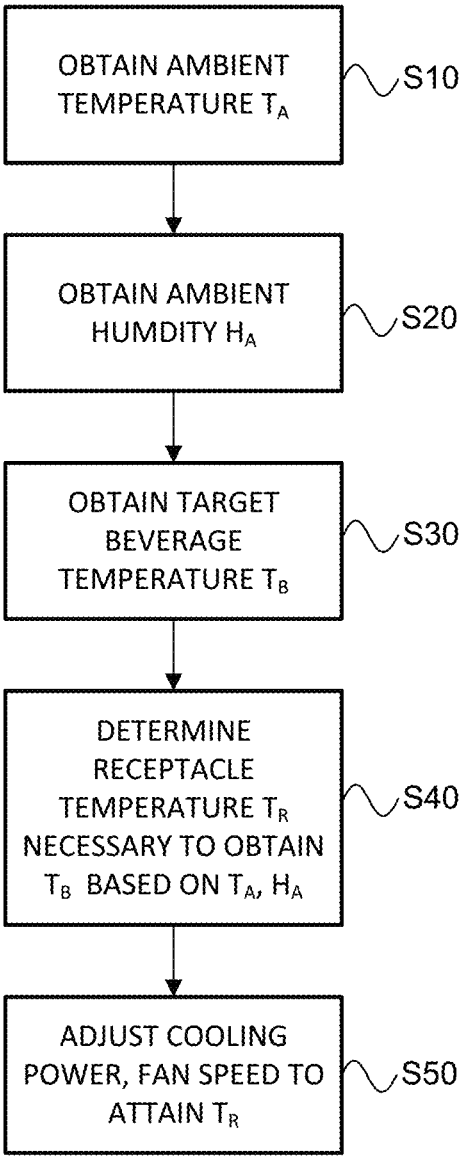
FIG. 10 is a flow chart of a procedure for controlling operation of a beverage container temperature control system according to one aspect of an embodiment.

Referring now to FIG. 10, a procedure for controlling operation of the beverage container temperature control system according to one aspect of embodiment will now be described. In a step S10, the ambient temperature is obtained using, for example, the sensor 280 described above located on the housing (FIG. 3A). Then in a step S20 the ambient humidity is obtained also from a sensor, for example, located on the housing. Note that these steps may be performed in either order. In step S30 a target beverage temperature is obtained. again, this step may be performed in any order with respect to steps S10 and S20. Step S30 may be performed by the system simply assuming that every beverage has the same target temperature. As an alternative, however, the system could detect or be provided with information on what beverage is being chilled and be provided with a target temperature for that particular beverage. Note that it could also be a step here of determining how much beverage is actually in the container if a sensor is provided for making that determination. In a step S40 the receptacle temperature that is necessary to obtain the target beverage temperature is then determined based at least in part on the ambient temperature and ambient humidity (and perhaps also amount of beverage). This step may be performed, for example, by reference to a look up table, by using an application specific integrated circuit, field programmable gate array, or by computation. Then, in a step S50, one or both of the cooling power or fan speed are adjusted to attain the desired receptacle temperature.

Thus, described herein is a beverage container temperature control system with exemplary embodiments having a generally cylindrical configuration. According to an aspect of an embodiment, heavier electronic components are positioned towards the bottom of the beverage container temperature control system to give the beverage container temperature control system an overall low center of gravity.

According to one aspect of an embodiment, the bottom portion of the beverage container temperature control system has a fan, a heat sink, and a Peltier cooler. It may also include provision for gyroscopic stabilization. The fan is arranged so as to expel warm air. Ambient air is drawn into an around the heat sink at a separate location from where warm air is expelled downward from the fan in a 360° ring. There is a parting wall between the hot air exhaust portion and the cold air intake. Ambient air is drawn in through the front and rear of the heat sink. In some embodiments, the inside wall of the beverage container temperature control system is in thermal communication with the cold side of the Peltier element and functions as a cold sink.

According to another aspect of an embodiment, the beverage container temperature control system is supplied with various temperature sensors. For example, there may be a temperature sensor at the top end of the interior cold sink to indicate the temperature at that point. Similar temperature sensors could be positioned at the middle, that is, halfway up the beverage container temperature control system or the middle of the cold sink and at the bottom end of the cold sink. The beverage container temperature control system can also include sensors on an outside casing to measure ambient temperature, humidity, light intensity, wind speed, and atmospheric pressure. As indicated, there may also be a temperature sensor at heat sink and there may be a temperature sensor at the air inlet.

For some applications, it may be desirable to avoid the use of a fan at all. For such applications, the inner portion of the device may be adapted to function as a cold sink in thermal contact with the cold side of the Peltier element. The outer casing may then be arranged to act as a heat sink. Heat pipes can be placed in the outer casing to promote better heat transfer. A vacuum may be maintained between the inner the walls of the inner chamber and the outside walls in order to reduce heat flow between the cold sink and the heat sink.

According to another aspect of an embodiment, the outer casing may be provided with fins to promote better heat transfer between the outer casing acting as a heat sink and the ambient air.

In accordance with another aspect of an embodiment, the beverage container temperature control system is dimensioned to have a diameter of at least 120 millimeters. This is to ensure the ability to use a large fan to obtain to avoid the use of a noisy, smaller fan. The inner diameter may be about 105 millimeters to accommodate the majority of wine bottles.

The beverage container temperature control system may be provided with a digital touch control system place on the bottom part of the beverage container temperature control system and not on the main body to ensure that the beverage container temperature control system is not actuated by accident when moving the beverage container temperature control system or a container within the beverage container temperature control system.

In an embodiment, the beverage container temperature control system has a circular configuration to promote air to air intake and outflow while limiting the space that must be dedicated to this aspect of its operation.

In accordance with another aspect of an embodiment, batteries are placed in the lower portion of the beverage container temperature control system to provide for a low center of gravity. In other words, the heavier components are placed in the bottom portion of the beverage container temperature control system with a lighter, passive top portion of the beverage container temperature control system. In accordance with another aspect of aspect of embodiment, the air inlet and outlet are angled to prevent liquids from contaminating the electronic and electric components housed in the base of the unit. Inner rubber pads may be provided on the inside cold plate to prevent damage to bottles or to limit noise production when the bottle comes into contact with the walls when moving the beverage container temperature control system handle or handling the bottle.

According to another aspect of an embodiment, a three sensor cold plate system is used to ensure an even temperature distribution and thermal transfer to the bottle and to avoid imparting thermal stresses to the bottle. A slanted top promotes access to the container and an integrated handle structure facilitates handling of the beverage container temperature control system. According to another aspect of an embodiment the bottom of the interior volume of the receptacle is provided with a cushioning layer which reduces the shock of impact to any container inserted into the receptacle.

In accordance with another aspect of an embodiment, a barcode or label scanner can be integrated to recognize the wine that is being placed into the beverage container temperature control system to automatically set the optimal temperature for that variety of wine. In other words, according to another aspect of an embodiment, the system may include a scanner arranged to detect and read elements of a beverage container including its label, e.g., a label on wine bottle, to provide an indication of the type and original quantity of a beverage and/or beverage container placed in the receptacle 130. The control system can then use the indication to, for example, adjust the internal temperature of the receptacle 130 accordingly.

According to another aspect of an embodiment an outside surface of the beverage cooling unit may be provided with a QR code which can be read by an external device with a camera or scanner such a smartphone to automatically direct a web browser on the external device to a website that provides recommended beverage temperatures or sells beverages.

The beverage container temperature control system can be provided with wireless telecommunication capability to connect with wine databases in order to obtain data about wines which could be displayed on a handheld smart phone, iPad, or other smart device. The device may include a memory which will contain data on the optimal settings for different varieties of wine. The device can include provision for an Internet of Things connection for smartphone operation or data retrieval. The device could communicate with wine merchants and wineries to provide them with information on when and how and where people are consuming their products.

In accordance with another aspect of an embodiment, a sensor may be included to detect how much wine is in the bottle. A procedure can be used to use all available data on the surrounding editions to compute the optimal AT for cooling. In accordance with another aspect of an embodiment, the beverage container temperature control system can include a presence sensor to detect when a bottle is in the beverage container temperature control system to shut off the cooler when the bottle is removed or not present after certain delay in order to preserve battery power. The integral carrying handle ensures robustness and easy transport. According to other aspects of an embodiment, a touch display is provided for setting the temperature. The touch display can just be an LED display capable of displaying different temperatures with different colors indicating different temperature ranges. Placement of the touch display in the bottom part rather than the main body of the cooler prevents interference with and isolation of the main body and minimizes touching the display area when carrying the unit or removing a bottle or placing from the unit or placing a bottle in the unit. The fan outlet is arranged to avoid sucking intake of dirt or other particulate matter that may be on a surface on which the unit has been placed. The unit may accommodate a Bluetooth speaker in its bottom part as well. The unit may be charging plate compatible and be compatible with external battery packs to provide the option of prolonged operation with an external battery pack. The unit could also be provided with a power mode where it can provide enhanced cooling operation when connected to line power. The insulation may include a phase change material.

The above description includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is construed when employed as a transitional word in a claim. Furthermore, although elements of the described aspects and/or embodiments may be described or claimed in the singular, the plural is contemplated unless limitation to the singular is explicitly stated. Additionally, all or a portion of any aspect and/or embodiment may be utilized with all or a portion of any other aspect and/or embodiment, unless stated otherwise.

What is claimed is:

1. Apparatus for controlling a temperature of a beverage container, the apparatus comprising:

a housing having an upper portion and a lower portion, the upper portion including a receptacle adapted to receive the beverage container;

a thermoelectric element positioned in the lower portion, the thermoelectric element having a first side at a first temperature and a second side at a second temperature lower than the first temperature, the second side being in thermal communication with the receptacle, the thermoelectric element being configured to operate at a first voltage;

a pin fin heat sink in thermal communication with the first side;

a sensor provided to sense the temperature of incoming ambient air to the pin fin heat sink;

at least one battery positioned in the lower portion and electrically connected to the thermoelectric element to provide power to the thermoelectric element, the battery having an output voltage greater than the first voltage; and a voltage converter adapted to down convert the output voltage of the at least one battery to the first voltage and for supplying the first voltage to the thermoelectric element.

2. The apparatus as claimed in claim 1 wherein the upper portion of the housing includes structure defining an integral handle.

3. The apparatus as claimed in claim 1 wherein the lower portion of the housing includes a touch sensitive dot matrix display.

4. The apparatus as claimed in claim 3 wherein the touch sensitive dot matrix display displays a set temperature.

5. The apparatus as claimed in claim 3 wherein the touch sensitive dot matrix display is configured to enable control of a set temperature.

6. The apparatus as claimed in claim 1 further comprising at least one temperature sensor for measuring at least one measured temperature in the receptacle.

7. The apparatus as claimed in claim 6 wherein the lower portion of the housing includes a touch sensitive dot matrix display displaying the at least one measured temperature.

8. The apparatus as claimed in claim 1 wherein the pin fin heat sink is positioned in the lower portion.

9. The apparatus as claimed in claim 8 wherein the lower portion includes air outlets at a base of the lower portion and air inlets positioned above and separated from the air outlets by a barrier and wherein a fan is arranged to draw air in through the air inlets, force the air through the heat sink, and exhaust the air passed through the heat sink out through the air outlets, wherein the air inlets are positioned above the air outlets when the apparatus is oriented vertically.

10. The apparatus as claimed in claim 1 wherein the apparatus further comprises a detector arranged to detect whether a container is present in the receptacle and wherein the apparatus is configured to place the apparatus in a low power mode if no container has been present in the receptacle for more than a predetermined period of time.

11. The apparatus as claimed in claim 1 wherein the apparatus further comprises a detector arranged to detect a characteristic of a container placed in the receptacle and wherein the apparatus selects the second temperature based on the characteristic.

12. The apparatus as claimed in claim 1 further comprising a volume detector arranged to detect a detected volume of liquid in a container inserted into the cradle and an indicator adapted to provide an indication of the detected volume.

13. The apparatus as claimed in claim 1 further comprising a temperature detector arranged to detect a detected temperature of the container and an indicator adapted to provide an indication of the detected temperature.

14. The apparatus as claimed in claim 1 further comprising a touch sensitive dot matrix display including a temperature selector arranged to select the second temperature as a set temperature and an indicator adapted to provide an indication of the set temperature.

15. The apparatus as claimed in claim 1 further comprising a communications module arranged to receive control data from an external device.

16. The apparatus as claimed in claim 1 further comprising a touch sensitive dot matrix display for inputting control data.

17. The apparatus as claimed in claim 1 further comprising a sensor provided on the housing to measure at least one of ambient temperature, humidity, light intensity, wind speed, and atmospheric pressure.

18. The apparatus as claimed in claim 1 further comprising a printed circuit board assembly wherein the pin fin heat sink is arranged to cool the at least one battery and the printed circuit board assembly.

19. The apparatus as claimed in claim 1 further comprising a tip tilt detection sensor arranged to detect tipping or tilting of the housing.

20. The apparatus as claimed in claim 1 further comprising a communication interface including a device for communicating data to or from the apparatus and an outside device.

21. Apparatus for controlling a temperature of a beverage container, the apparatus comprising:

a cylindrical housing having an upper portion and a lower portion, the upper portion including a cylindrical receptacle adapted to receive the beverage container, the cylindrical housing having a slanted upper rim defining a raised portion and an integral handle in the raised portion;

a thermoelectric element positioned in the lower portion, the thermoelectric element having a first side at a first temperature and a second side at a second temperature lower than the first temperature, the second side being in thermal communication with the receptacle, the thermoelectric element being configured to operate at a first voltage;

a pin fin heat sink in thermal communication with the first side;

a sensor provided to sense the temperature of incoming ambient air to the pin fin heat sink;

a fan arranged to ventilate the heat sink and positioned in the lower portion;

at least one battery positioned in the lower portion and electrically connected to the thermoelectric element to provide power to the thermoelectric element, the battery having an output voltage greater than the first voltage; and a voltage converter adapted to down convert the output voltage of the at least one battery to the first voltage and for supplying the first voltage to the thermoelectric element.

* * * * *